United States Patent [19]

Iannarone

[11] 4,343,253

[45] Aug. 10, 1982

[54] LID AND HINGE ARRANGEMENT FOR A CONVERTIBLE SEWING MACHINE

[75] Inventor: Ronald C. Iannarone, Hillside, N.J.

[73] Assignee: The Singer Company, Stamford, Conn.

[21] Appl. No.: 41,955

[22] Filed: May 23, 1979

[51] Int. Cl.[3] ..... D05B 73/10

[52] U.S. Cl. ..... 112/260; 16/259

[58] Field of Search ..... 112/258, 259, 260, 217.1, 112/13; 16/DIG. 13, 148, 163, 171, 172, 175, 176, 147; 312/22, 26, 24, 27

[56] References Cited

U.S. PATENT DOCUMENTS

| | | | |
|---|---|---|---|
| 1,438,255 | 12/1922 | Moulton | 112/260 |
| 2,732,581 | 1/1956 | Heck | 16/171 |
| 2,913,758 | 11/1959 | Jacobson | 16/147 |
| 3,188,993 | 6/1965 | Szuba et al. | 12/258 |
| 3,344,762 | 10/1967 | Szostals et al. | 112/260 |
| 3,685,093 | 8/1972 | Sanders et al. | 16/147 |
| 3,863,582 | 2/1975 | Patricia et al. | 112/158 |
| 4,009,671 | 3/1977 | Wittler et al. | 112/260 X |
| 4,129,922 | 12/1978 | Law et al. | 112/258 X |

FOREIGN PATENT DOCUMENTS

| | | |
|---|---|---|
| 53-113757 | 9/1978 | Japan . |
| 53-128053 | 10/1978 | Japan . |

*Primary Examiner*—Werner H. Schroeder
*Assistant Examiner*—Andrew M. Falik
*Attorney, Agent, or Firm*—James M. Trygg; Robert E. Smith; Edward L. Bell

[57] ABSTRACT

A convertible sewing machine bed lid and hinge arrangement includes a lid that may be pivoted downwardly to expose an elongated arm for sewing tubular garments. The lid has depending pivot bosses and the bed has a web casting that includes legs connected to the bosses by the hinge pins fitted into apertures in the bosses and slots in the legs. A pair of leaf springs held by projections that interlock with the casting entrap the pins within the slots and urge them toward a closed extremity of the slots. Latching projections on the free side of the lid are resiliently forced into recesses in the arm to retain the lid in a horizontal position to provide an expansive work supporting surface.

7 Claims, 3 Drawing Figures

Fig. 1.
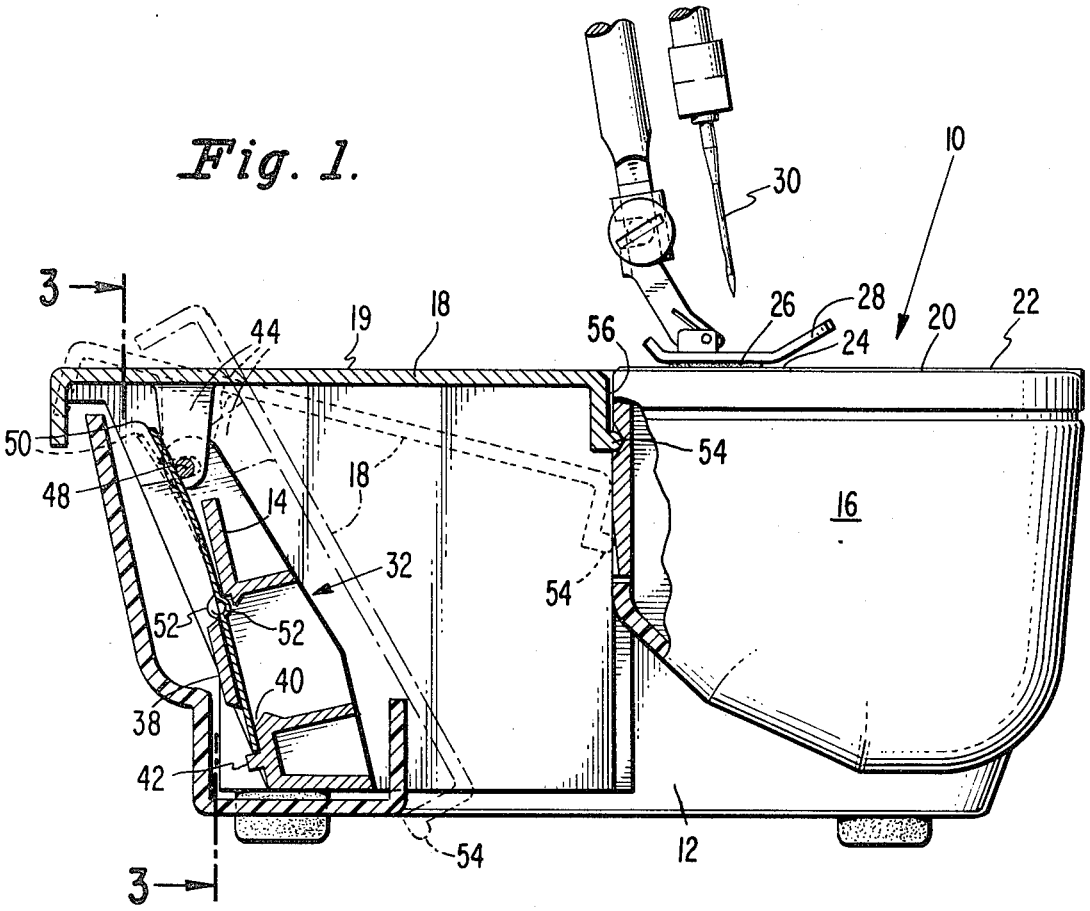
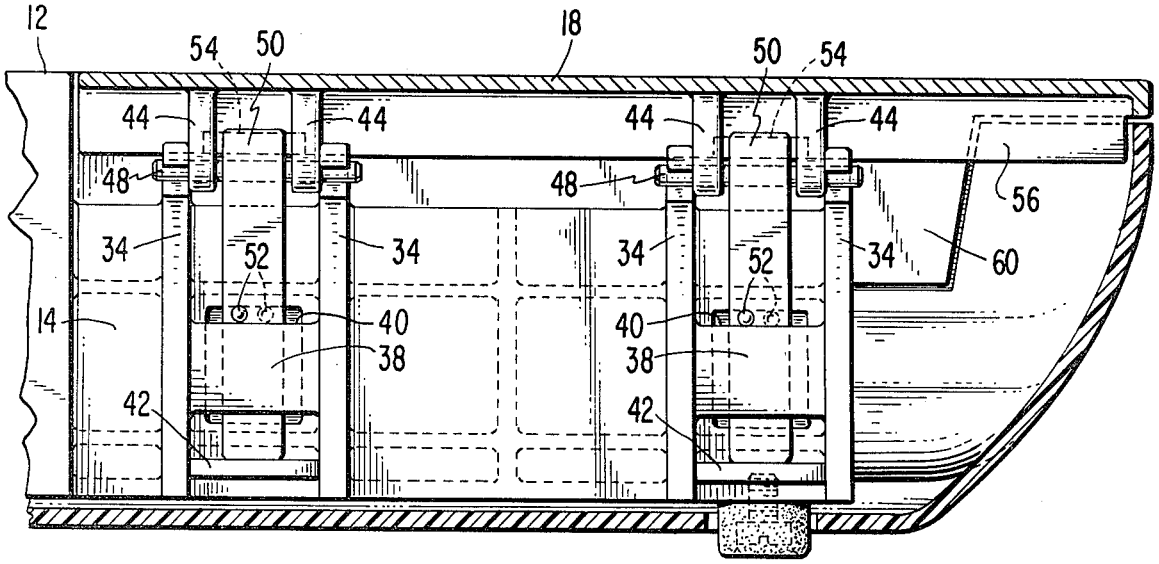
Fig. 3.

LID AND HINGE ARRANGEMENT FOR A CONVERTIBLE SEWING MACHINE

BACKGROUND OF THE INVENTION

1. Field of the Invention

This invention relates to convertible sewing machines in general, and more particularly to a latch and hinge arrangement in which a pivotally mounted supplemental work supporting surface is mounted to enable a machine to accommodate sewing material having a flat shape or sewing material generally tubular in shape.

2. Description of the Prior Art

Sewing machines are known in the prior art in which the base, or bed, is convertible to permit the sewing of flat or tubular material. One such machine is disclosed in U.S. Pat. No. 3,863,582 of Patricia et al. The lid disclosed in the Patricia et al. patent is fastened to the sewing machine base by a pair of cylindrical pins that pass through bosses on the lid and engage upstanding legs on the base. The lid has a spring-biased detent that engages a depression in the bed to retain the lid in a bridging position.

Other convertible bed sewing machines are known in which the lid must be slid away from the cylindrical portion of the bed to permit the sewing of tubular garments thereon. The necessity to remove the detachable lid to convert the machine from flat bed to cylinder bed operation and to replace the lid to convert the machine back to flat bed operation is, among other things, a bothersome inconvenience, especially when frequent conversions are made between flat and tubular sewing materials.

It is desirable to provide a sewing machine having a convertible bed that may be easily converted from a flat, expansive support surface to one which will accommodate tubular garments. The convertible bed configuration should be easily changed to the flat bed configuration by a minimum effort on the part of the sewing machine operator. It is also desirable to provide a convertible bed lid that may be easily manufactured and may be assembled from a minimum number of low tolerance parts.

One problem with prior known convertible bed lids is that they required the assembly of close tolerance parts to operate properly.

Another problem is that prior known convertible bed lids required separate fasteners, or latches, to support them in the raised position.

Still another problem is that some prior known lids were susceptible to being accidentally unlatched due to pressure of the operator's hand on the lid.

OBJECTS AND SUMMARY OF THE INVENTION

It is an object of this invention to provide a convertible sewing machine bed lid and hinge that will permit a sewing machine operator to convert the sewing machine bed easily to sew either flat or tubular garments.

It is also an object to provide a convertible sewing machine bed lid and hinge that can be assembled from a minimum number of parts.

Still another object is to produce a convertible lid and hinge which has an easily operated latch that will not interfere with the manipulation of fabric on the sewing machine bed.

The foregoing objects and other advantages are achieved in a convertible bed sewing machine that has an elongated arm and an elongated stand portion spaced from the arm and rigidly extending from the sewing machine base. A convertible bed lid is pivotally attached to the stand portion by cylindrical hinge pin means that engage boss means depending from the undersurface of the lid and upwardly extending support means, such as legs, rising from the stand portion of the sewing machine base. In one embodiment, there are two upwardly extending pairs of legs and two depending bosses, each of which is aligned between a respective pair of the legs. The legs have slots that are open in the direction away from the elongated arm and closed at the other end closer to the arm. Leaf springs are retained by the stand in a position to bear against the hinge pins to retain them in the slots and to urge the hinge pins and the bosses in which they are journalled toward the elongated arm so as to press the free edge of the lid against the arm.

Means are provided to lock the lid in a horizontal, or bridging, position so that its upper surface is an extension of the upper surface of the arm to permit the machine to act as a flat bed machine. The locking means consists of one or more tabs fixedly protruding from free edge of the lid and engaging corresponding depressions in the juxtaposed surface of the elongated arm. The leaf springs provide a resilient force urging the tabs into the depressions to hold the lid in its horizontal position, and they also provide sufficient freedom to allow the hinge pins to slide in the slots far enough to allow the tabs to be pressed past rigid portions of the arm and into the depression. The lid may be moved from its horizontal bridging position to a lowered position away from the elongated arm by depressing the free edge of the lid downwardly.

Instead of having the slots in the upwardly extending legs, they can be in the depending bosses, and the hinge pins can be held in apertures in the legs. In that case, the leaf spring means should be carried on the lid, as the open edge of the slots on the bosses should face the free edge of the lid to allow sufficient lateral movement of the lid for the tabs to enter the depressions to hold the lid in its horizontal bridging position.

BRIEF DESCRIPTION OF THE DRAWINGS

The above and other objects of this invention will become evident from the description of the preferred embodiment which is hereinafter set forth in such detail as to enable those skilled in the art to readily understand the function, operation, construction and advantages of it when read in conjunction with the accompanying drawings in which:

FIG. 1 is an end view, partly in section, of the bed of a convertible bed sewing machine having the teachings of this invention applied thereto;

FIG. 3 is a rear sectional view taken along line 3—3 of FIG. 1 showing the hinge mechanism of the convertible bed.

DESCRIPTION OF THE PREFERRED EMBODIMENT

Figure 2:
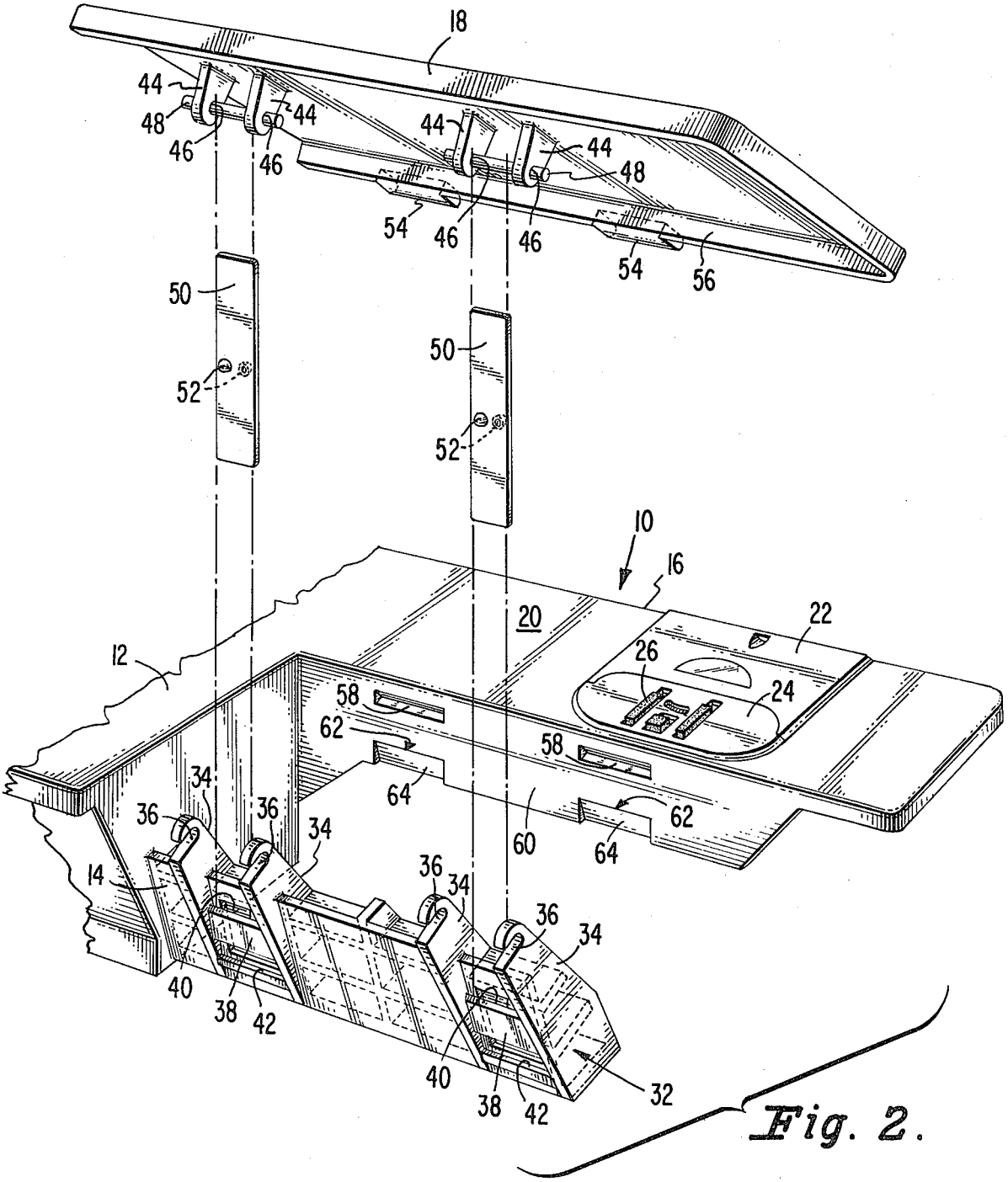
FIG. 2 is a disassembled perspective view of the hinge mechanism and lid of the convertible bed shown in FIG. 1.

FIG. 1 shows a fragment of a convertible bed sewing machine having a bed 10. The bed 10 includes a base 12 having a stand portion 14 which, for stabilization purposes, may be secured to a support cabinet or other similar structure (not shown). The bed 10 further comprises an elongated arm 16 that freely extends from the base 12 in parallel spaced relationship from the stand portion 14. A hinged lid 18 having a supplemental work supporting surface 19 bridges the space between the stand portion 14 and the elongated arm 16 when the lid is in a substantially horizontal position, as shown.

The elongated arm 16 includes a primary work supporting surface 20 that accommodates a slide cover 22, and a throat plate 24 through which a feed dog 26 projects. Any conventional presser device 28 may be used to hold the fabric being sewn in place against the upward thrust of the feed dog 26. The feed dog 26 moves the fabric, or garment, being sewn past an endwise reciprocating needle 30.

FIG. 2 best illustrates that the stand 14 is preferably formed from a web casting 32 that, in this embodiment, includes two pairs of upstanding legs 34. Each of the legs 34 has a slot 36 formed near its top extremity, and one end of each of the slots is open outwardly in a direction away from the elongated arm 16. The web casting 32 also contains a set of horizontal braces 38 between each of the pairs of legs 34. The braces 38 are spaced away from the legs 34 so that a slot 40 is formed behind each brace 38. The web 32 also contains a set of tabs 42 spaced below the braces 38 and extending outwardly from the web 32.

FIG. 2 also shows two pairs of spaced pivot bosses 44 that extend downwardly from the under surface of the lid 18 near one side of the lid. The bosses 44 have apertures 46 therethrough so, in this embodiment, each pair of bosses 44 may receive a cylindrical roll, or hinge pin 48 which is supported therebetween. FIG. 3 shows that the bosses 44 are positioned on the lid 18 so that each pair of bosses 44 is between a pair of legs 34. The apertures 46 are positioned on the bosses 44 so that, when the lid 18 is bridging the space between the stand portion 14 and the elongated arm 16, the pins 48 occupy a position within the slots 36.

A leaf spring 50 is received in each of the slots 40 between the pairs of legs 34 and the lower ends of the springs 50 are pressed against the tabs 42. FIG. 1 best shows the manner in which the springs 50 restrain the pins 48 within the elongated slots 40 but still permit limited horizontal motion of the pins 48 within the slots. Preferably each of the springs 50 has two oppositely directed dimples 52 that lock against oppositely directed edges of the braces 38 and the main part of the stand 14 to aid the braces 38 in retaining the springs within the web 32.

As shown in FIG. 3, the lid 18 includes locking means that include one or more latching tabs 54 on a lip 56 of the lid to retain the lid 18 in a horizontal bridging position between the stand 14 and the elongated arm 16. Preferably the elongated arm 16 has one or more horizontal depressions 58 formed in an inside wall 60 thereof to receive the tabs 54 when the lid 18 is in a horizontal position. The inside wall 60 also has at least one slot 62 vertically aligned with the depressions 58. Each slot 62 has a sloped wall 64 that engages the latching tabs 54 and acts to apply increasing force to the hinge pins 48 against the springs 50 when the lid 18 is being raised from a lowered position to a horizontal position to bridge the space between the stand 14 and the elongated arm 16. When the lid 18 is in its horizontal position, the force of the springs 50 against the roll pins 48 causes the latching tabs 54 to remain within the depressions 58.

The arrangement of components can be easily assembled during manufacturing of the sewing machine by first placing the pins 48 in the apertures 46 to bridge the space between each pair of the bosses 44. A leaf spring 50 is pushed into each of the slots 40 behind the respective braces 38 so that the lower extremity of each of the springs rests against the tabs 42. The lid 18 is then aligned so that each pair of bosses 44 is between a pair of legs 34. The lid is pushed rearwardly so that the cylindrical pins 48 deflect the leaf springs 50 far enough to allow the pins 48 to be pushed downwardly into the slots 36. The leaf springs 50 thereafter exert a horizontal force on the pins 48 and prevent their accidental movement from within the confines of the slots 36.

FIG. 1 best illustrates that when the lid is moved from a horizontal position to a lowered position so that tubular garments may be supported on the elongated arm 16, the lid 18 is pushed downwardly, which causes the latching tabs 54 to pop out of the depressions 58. In so doing the tabs 54 push against the inside wall 60, and cause the pins 48 to push outwardly away from the closed extremity, of the slots 36. The leaf springs 50 prevent the pins 48 from becoming disengaged from the slots 36 by exerting a force against the pins to urge them toward the closed end of each of the slots 36. The slots 62 accommodate the tabs 54 as the lid 18 is moved downwardly. The lid 18 may be raised by grasping its exposed end and pivoting the lid back to a horizontal position so that the tabs 54 are engaged within the depressions 58. The slots 62 form entrance ramps for the tabs 54 as the lid is pivoted upwardly. In the uppermost position of the lid, the supplemental work supporting surface 19 forms a contiguous extension of the primary work supporting surface 20.

It will be appreciated that since the convertible bed lid may be easily moved from a horizontal to a lowered position with a minimum amount of operator effort, it will be convenient to switch rapidly between sewing tasks requiring a free arm and those requiring an expansive work supporting surface. Further, the relative lack of protruding latching elements reduces the potential for snagging delicate fabrics.

While the lid and hinge arrangement disclosed herein has been shown on a household sewing machine, it will be apparent to those skilled in the art that it may also be incorporated in sewing machines designed for industrial use.

From the above detailed description of a preferred embodiment of the invention it will be seen that a novel convertible bed lid and hinge arrangement is disclosed which is easy to assemble and which does not need extensive alignment to operate properly. While the invention has been described in its preferred embodiment, it will be obvious to those skilled in the art in light of the above teachings that various changes and modifications may be made thereto. For example, but not by way of limitation, it is entirely feasible within the scope of the disclosed invention to have the hinge pin carried on the stand portion and be received within a pair of elongated slots carried on the bosses depending from the lid. It is also feasible to have the means for retaining the hinge pin within the elongated slots carried on the lid. All modifications which do not depart from the spirit of the invention are intended to be included within the scope of the appended claims.

I claim:

1. In a sewing machine having a base, an elongated arm including a primary work supporting surface extending longitudinally from said base, and a support stand extending longitudinally from said base in spaced relation from said elongated arm, the invention comprising:

a lid including a supplemental work supporting surface thereon hingedly supported from said stand for movement between a substantially horizontal position, in which the supplemental work supporting surface serves as an extension of the primary work supporting surface on the elongated arm, and a lowered position that permits free arm sewing on the elongated arm;

rigid locking means interlocking the lid with the arm to hold the lid in the substantially horizontal position;

first means extending from said stand;

second means depending from the lid in spaced relation with the first means when said lid is hingedly fastened to said stand, one of the first and second means comprising substantially horizontal slot means open at one end facing away from the arm, the other end of said slot means terminating in a closed end, and the other of said first and second means comprising aperture means;

a hinge pin carried in said aperture means and received within said slot means and slidable laterally relative to the axis of the hinge pin with the extent of the slot means; and spring means held by said one of said first and second means and extending adjacent the open end of said slot means for retaining said hinge pin within said slot means and urging the locking means into interlocking position but resiliently permitting the lid to be slid away from the arm within the extent of the slot means to allow disengagement of the locking means.

2. The arrangement as set forth in claim 1 wherein said spring means for retaining said hinge pin within said slot means comprises at least one leaf spring restrained to urge said hinge pin toward the closed end of said slot means.

3. The arrangement as set forth in claim 2 comprising a second leaf spring, said first means comprising first and second legs, said stand comprising first and second spring-receiving slots for receiving each of said leaf springs, respectively, said leaf springs urging said hinge pin toward the closed end of said slot means.

4. The arrangement as set forth in claim 3 wherein said locking means comprise a tab fixedly protruding from said lid toward said elongated arm, and a depression in said elongated arm for receiving said tab.

5. The arrangement as set forth in claim 3 wherein each of said leaf springs contains at least one dimple for retaining the respective one of said leaf springs within said spring-receiving slots of the stand.

6. In a sewing machine having a base, an elongated arm including a primary work supporting surface extending longitudinally from said base, and a support stand extending longitudinally from said base in spaced relation from said elongated arm, the invention comprising:

a lid including a supplemental work supporting surface thereon hingedly supported from said stand for movement between a substantially horizontal position, in which the supplemental work supporting surface serves as an extension of the primary work supporting surface on the elongated arm, and a lowered position that permits free arm sewing on the elongated arm;

at least two spaced legs extending upwardly from said stand;

a hinge pin supported between said spaced legs;

at least two bosses depending from said lid, said bosses aligning in spaced relation with said legs when said lid is hingedly fastened to said stand;

a substantially horizontal slot formed in each of said legs, said slots extending away from the elongated arm to a closed end, the ends of said slots facing away from the elongated arm being open, said hinge pin being received within the elongated slots of said legs and slidable laterally relative to the axis of the hinge pin with the extent of said slots; and resilient means carried on the stand for retaining said hinge pin within the slots.

7. The arrangement as set forth in claim 6 wherein said means for retaining said hinge pin within said slots comprises at least one leaf spring carried on said lid to urge said hinge pin toward the closed end of said elongated slots.

* * * * *